US009135805B2

(12) United States Patent
Freedman et al.

(10) Patent No.: US 9,135,805 B2
(45) Date of Patent: Sep. 15, 2015

(54) METHODS AND SYSTEMS FOR ENCOURAGING AND ENFORCING HAND HYGIENE

(71) Applicant: IntelligentM, Sarasota, FL (US)

(72) Inventors: Seth Freedman, Sarasota, FL (US); Andrew Fine, Sarasota, FL (US); Dave Mullinix, Austin, TX (US)

(73) Assignee: IntelligentM, San Francisco, CA (US)

( * ) Notice: Subject to any disclaimer, the term of this patent is extended or adjusted under 35 U.S.C. 154(b) by 66 days.

(21) Appl. No.: 13/973,539

(22) Filed: Aug. 22, 2013

(65) Prior Publication Data

US 2014/0266692 A1 Sep. 18, 2014

Related U.S. Application Data

(63) Continuation-in-part of application No. 13/987,290, filed on Mar. 15, 2013, now abandoned.

(60) Provisional application No. 61/616,399, filed on Mar. 27, 2012.

(51) Int. Cl.
*G08B 1/08* (2006.01)
*G08B 21/24* (2006.01)

(52) U.S. Cl.
CPC ..... *G08B 21/245* (2013.01)

(58) Field of Classification Search
CPC ..... G08B 21/24
USPC ..... 340/539.11, 539.12, 573.1
See application file for complete search history.

(56) References Cited

U.S. PATENT DOCUMENTS

| | | | | |
|---|---|---|---|---|
| 5,014,040 | A * | 5/1991 | Weaver et al. | 340/568.1 |
| 5,374,921 | A * | 12/1994 | Martin et al. | 340/539.11 |
| 5,812,059 | A | 9/1998 | Shaw et al. | |
| 6,426,701 | B1 * | 7/2002 | Levy et al. | 340/573.1 |
| 6,605,038 | B1 | 8/2003 | Teller et al. | |
| 6,727,818 | B1 * | 4/2004 | Wildman et al. | 340/573.1 |
| 7,020,508 | B2 * | 3/2006 | Stivoric et al. | 600/390 |

(Continued)

OTHER PUBLICATIONS

Dan Sutch and Tash Lee, Fizzees, futurelab (May 2006).

(Continued)

*Primary Examiner* — Eric M Blount
(74) *Attorney, Agent, or Firm* — Michael Best & Friedrich LLP

(57) ABSTRACT

A method of and system for monitoring an instance and a duration of hand-washing activity using a lightweight, wearable device including a radio frequency identification tag reader; an external communication device; an alarm device that is adapted to generate at least one of a visual, an audible, and a haptic signal; data storing device(s) having multi-dimensional movement, acceleration, and/or moment data representative of hand-washing activity; an accelerometer to measure multi-dimensional movement and acceleration of the device; a gyroscope to measure multi-dimensional movement and moment of the device; and a processing device that uses measured multi-dimensional movement, acceleration, and/or moment data to evaluate hand-washing activity by determining when hand-washing activity has begun and ended and by comparing the duration of hand-washing activity to a pre-determined minimum hand-washing requirement, to determine whether or not said hand-washing activity complies with the minimum hand-washing requirements.

16 Claims, 6 Drawing Sheets

(56) References Cited

U.S. PATENT DOCUMENTS

| | | | | |
|---|---|---|---|---|
| 7,242,306 | B2 * | 7/2007 | Wildman et al. | 340/573.1 |
| 7,372,367 | B2 | 5/2008 | Lane et al. | |
| 7,375,640 | B1 | 5/2008 | Plost | |
| 7,770,782 | B2 | 8/2010 | Sahud | |
| 7,818,083 | B2 | 10/2010 | Glenn et al. | |
| 7,855,651 | B2 | 12/2010 | LeBlond et al. | |
| 7,898,407 | B2 | 3/2011 | Hufton et al. | |
| 7,978,083 | B2 | 7/2011 | Melker et al. | |
| 8,094,029 | B2 | 1/2012 | Ortiz et al. | |
| 8,196,810 | B2 | 6/2012 | Sahud | |
| 8,237,558 | B2 | 8/2012 | Seyed Momen et al. | |
| 8,294,584 | B2 | 10/2012 | Plost | |
| 8,344,893 | B1 | 1/2013 | Drammeh | |
| 8,395,515 | B2 | 3/2013 | Tokhtuev et al. | |
| 8,558,660 | B2 * | 10/2013 | Nix et al. | 340/5.1 |
| 8,587,437 | B2 * | 11/2013 | Kyle et al. | 340/573.1 |
| 8,698,637 | B2 | 4/2014 | Raichman | |
| 2007/0173705 | A1 | 7/2007 | Teller et al. | |
| 2008/0131332 | A1 | 6/2008 | Nguyen et al. | |
| 2008/0136649 | A1 | 6/2008 | Van De Hey | |
| 2010/0315244 | A1 * | 12/2010 | Tokhtuev et al. | 340/603 |
| 2011/0103195 | A1 * | 5/2011 | Wilbur et al. | 368/76 |
| 2011/0291840 | A1 * | 12/2011 | Pelland et al. | 340/573.1 |
| 2012/0112906 | A1 * | 5/2012 | Borke et al. | 340/539.13 |
| 2013/0027199 | A1 * | 1/2013 | Bonner | 340/539.11 |

OTHER PUBLICATIONS

Ince, N.F. et al., "Detection of Early Morning Daily Activities with Static Home and Wearable Wireless Sensors," EURASIP Journal on Advances in Signal Processing, vol. 2008 (Jul. 17, 2007).

Healthsense eNeighbor Remote Monitoring web page: http://www.healthsense.com/index.php/products/eneighbor-remote-monitoring, publicly available prior to (Mar. 27, 2012).

* cited by examiner

METHODS AND SYSTEMS FOR ENCOURAGING AND ENFORCING HAND HYGIENE

CROSS-REFERENCE TO RELATED APPLICATIONS

This application is a continuation-in-part and claims priority to and the benefit of U.S. patent application Ser. No. 13/987,290 filed on Mar. 15, 2013, which is a non-provisional application of and claims priority to U.S. Provisional Application No. 61/616,399, filed on Mar. 27, 2012.

FIELD OF THE INVENTION

A method of and a device and system for monitoring, collecting, transmitting, storing, and using data related to hygienic activity is disclosed and, more specifically, a method and a system that are capable of monitoring, collecting, transmitting, storing, and using motion and/or proximity data related to hand-washing activity, to determine conformance with hand hygiene guidelines, such as, e.g., those promulgated by the World Health Organization (WHO).

BACKGROUND OF THE INVENTION

A health care worker's hands are the main route infections take to move from one patient to another. A recent study of several intensive care units—where a patient's vulnerability to infection is the highest—showed that hands were washed on only one quarter of the necessary occasions. To combat this issue, hospitals are implementing numerous strategies to promote hand-washing and, moreover, to monitor compliance with hand-washing directives and guidelines. Such directives and guidelines include, for example, the World Health Organization's (WHO) "Hand Hygiene Guidelines in Health Care" (the "WHO Guidelines") that describe best practices for hand-washing and other hygiene events. See, e.g., http://www.who.int/gpsc/5may/Hand_Hygiene_Why_How_and_When_Brochure.pdf). Furthermore, the newly developed "Five Moments for Hand Hygiene" have emerged from the WHO guidelines, which adds value to any hand hygiene improvement strategy. Quite simply, the WHO guidelines define five key moments for hand hygiene, overcoming misleading language and complicated descriptions. Moreover, the WHO guidelines present a unified vision and promote a strong sense of ownership. Indeed, not only do the "Five Moments" align with the evidence base concerning the spread of healthcare-acquired illnesses, but it is interwoven with the natural workflow of care. Advantageously, the WHO guidelines and the "Five Moments" are designed to be easy to learn, logical, and applicable in a wide range of settings.

The first of the "Five Moments" for hand hygiene occurs before patient contact, e.g., before shaking a patient's hand, before helping a patient move around, before a clinical examination, and so forth. The second of the "Five Moments" occurs before any aseptic task, e.g., before performing oral/dental care, before secretion aspiration, before wound dressing, before catheter insertion, before preparation of food or preparation of medicine, and so forth. The third of the "Five Moments" occurs after a body fluid exposure risk, e.g., after oral/dental care, after secretion aspiration, after drawing and manipulating blood, after clearing urine or feces, after handling wastes, and so forth. The fourth of the "Five Moments" occurs after patient contact, e.g., after shaking a patient's hand, after helping a patient move around, after a clinical examination, and so forth. The fifth of the "Five Moments" occurs after contact with patient surroundings, e.g., after changing bed linens, after perfusion speed adjustment, and so forth.

Notwithstanding, it is rare to find a hospital that has been able to maintain a hand-washing rate above 50 percent. Compliance can only improve if hospitals monitor which of its health care workers (HCWs) is or is not cleaning his/her hands; under what circumstances the HCW is performing hand-washing activity; and whether or not the HCW is performing hand-washing activity correctly, e.g., for a pre-designated length of time, for those particular circumstances. Moreover, individual doctors and nurses need to know his/her own hand-washing rates, and these data need to be easy to collect and analyze.

Although the "Five Moments" look good on paper, there are currently no methods that exist for monitoring compliance with these suggested practices beyond visual observation of healthcare workers. Moreover, there is a need for a method for electronically monitoring hand hygiene and, more particularly, electronically monitoring compliance with all five of the "Five Moments." Prior art systems and methods for providing automated hand-washing monitoring and for verifying compliance of hand-washing activity have focused on certain features or devices that are inherent to the systems. Unfortunately, these features and devices merely serve as surrogates for the hand-washing activity itself Some of the prior art focuses on the dispensing device ("dispenser") and/or the dispensing act in which a hand-washing agent, liquid, solution and the like is dispensed ostensibly unto a HCW's hands. For example, U.S. Pat. No. 7,855,651 to LeBlond, et al. and U.S. Pat. No. 8,094,029 to Ortiz, et al. focus on the dispenser and, more specifically, record the number of times each dispenser is used by the entire HCW population. Disadvantageously, the system and method account for a general population rather than look at a discrete individual or practice group. Furthermore, both patents further rely on a "globally accepted human observation method" to determine, first, the number of hand hygiene opportunities during a desired, predetermined, and/or specified period of time; and, second, to compute a Hand Hygiene Rate, which is disclosed in the WHO's "Guidelines on Hand Care in Health Care", based on the manually-determined observed number of opportunities and the automatically-recorded dispenser uses.

U.S. Pat. No. 7,898,407 to Hufton, et al. and U.S. Pat. No. 8,237,558 to Seyed Momen, et al. equate hand hygiene to the use of a dispenser and the dispensing act, further incorporating temporal requirements that are determined between the time of dispensing and a pre-established, acceptable hand-washing time and between the time of dispensing and the entry time into a zone for which hand hygiene is warranted. Alert devices inform HCWs, respectively, that they have washed their hands for the acceptable period of time, e.g., by activating a light-emitting device, or that an acceptable time has passed between the dispensing act and zone entry, e.g., by activating an audible alarm, haptic device, and the like. In each instance, though, the system assumes that the HCWs are actively and vigorously performing hand hygiene until the pre-established time is reached.

Still other patents focus on the hand-washing agent, liquid, solution, and the like used for hand cleansing. For example, U.S. Pat. No. 7,818,083 to Glenn, et al. focuses on whether or not the dispensed liquid is an "authorized solution", while U.S. Pat. No. 7,375,640 to Plost focuses on the volume of hand-washing agent dispensed. In each instance, once again, the systems and methods assume but cannot ensure that the HCW are actively and vigorously performing hand hygiene for a pre-established time.

SUMMARY OF THE INVENTION

To combat this problem, aspects of the invention provide wearable devices that monitor, collect, store, and transmit data related to hand-washing tasks of the wearer. Although the invention will be described in the context and environment of HCWs, the invention is not to be construed as being limited thereto, as those of ordinary skill in the art can adapt the system to, for example, the food service industry, the child care industry, public education, general workplaces, and so forth. In one particular embodiment, the invention takes the form of a wearable device such as a lightweight, wrist-worn smart-band ("wristband"). In other embodiments, the invention may take the form of an armband, ring or other wearable device that can detect multi-dimensional hand movement. In one embodiment, the present invention discloses a lightweight, wearable device for monitoring an instance and a duration of hand-washing activity. The device includes a radio frequency identification tag reader; an external communication device for communicating with a remote server; an alarm device that can generate a visual, an audible, and/or a haptic signal; a data storage device for storing data and an application(s), an algorithm(s), and a driver program(s) having multi-dimensional movement and acceleration data representative of hand-washing activity; an accelerometer for measuring multi-dimensional movement and acceleration of the device; and a processing device that can call and execute an appropriate application(s), algorithm(s), and/or driver program(s) that uses measured three-dimensional movement and acceleration data to evaluate hand-washing activity. A power supply device can include a battery and a wireless-charging component. Optionally, the device can also include a gyroscope for measuring multi-dimensional movement and moment of the device, in which case, the processing device can call and execute an appropriate application(s), algorithm(s), and/or driver program(s) that uses measured multi-dimensional movement and moment data to evaluate hand-washing activity.

In another embodiment, the device preferably weighs between one (1) and four (4) ounces and more preferably weighs 2 ounces; has a thickness of approximately 0.5 inches; and has a width between 0.5 inches and one (1) inch and, more preferably, has a width of approximately 0.8 inches. The device can be a wristband device; a ring; and/or an armband device.

The central housing portion is designed to be shockproof, watertight, and/or airtight and includes a cover portion for encasing or substantially encasing the central housing portion; and an attaching portion for securing the device at or near a wearer's wrist or forearm.

In another embodiment, the present invention discloses a system for monitoring an instance and a duration of hand-washing activity. The system includes the device described hereinabove as well as a dispenser(s)s for dispensing a hand-washing agent, directionally-controlled tags disposed on a zone(s), a room(s), means of access and egress, and a passageway(s); unique passive radio frequency tags that are affixed to a medical supply(ies), medical device(s), or fixture(s) within a medical care facility; and a second processing device that is in communication with a data storing device. The second processing device is capable of charging the wearable device, initiating remote diagnostics of the wearable device, uploading collected data from the first processing device to a remote, cloud-based server, and downloading remote software and firmware updates onto the first processing device. Optionally the wearable device in the system further includes a gyroscope. A charger housing device can be included in the system to receive multiple wearable devices, to wirelessly charge each of the wearable devices.

In yet another embodiment, the present invention discloses a method of monitoring an instance and a duration of hand-washing activity. The method includes the steps of monitoring an environment for identification tag signals; identifying a source of a monitored tag signal; calling from a database and executing an application(s), an algorithm(s), and a driver program(s) corresponding to the identified signal source; measuring movement and acceleration of the wearable device; determining when hand-washing activity has begun by comparing measured movement, acceleration, and/or moment data to data providing indicia of hand-washing activity stored in a corresponding database; determining when hand-washing activity has ceased by comparing measured movement, acceleration, and/or moment data to the data providing indicia of hand-washing activity; calculating a duration of hand-washing activity; and comparing the duration of hand-washing activity to a pre-determined minimum hand-washing requirement, to determine whether or not said hand-washing activity complies with the minimum hand-washing requirements, which are provided in guidelines, e.g., the World Health Organization guidelines for hand hygiene, that are stored in an appropriate database.

Additional features of the method include generating alarms for certain purposes. For example, a continuous alarm signal can be generated until remedial hand-washing activity complies with the minimum hand-washing requirements and another signal can be generated to notify the wearer that movement, acceleration, and/or moment data are being recorded. After calculating a duration of time between a most recent hand-washing activity and an entry time into a zone or room and/or an opening time of a medical supply or medical device and determining whether or not the duration of time exceeds a pre-established threshold time, the method can include alerting a wearer to perform remedial hand-washing activity if the duration of time is greater than the pre-established threshold time. The method can also generate a signal of noncompliance if the duration is greater than the pre-established threshold time, further recording in the data storage device a date and time of the noncompliance signal. Alternatively, a continuous alarm signal can be generated until remedial hand-washing activity complies with the minimum hand-washing requirements.

In yet another feature, the method can include determining when a remedial hand-washing activity has begun; determining when the remedial hand-washing activity has ceased; calculating a duration of remedial hand-washing activity; and comparing the duration of re-medial hand-washing activity to the pre-determined minimum hand-washing requirements, to determine whether or not said remedial hand-washing activity complies with the minimum hand-washing requirements. Determining when remedial activity has begun and/or ceased, can be effected by comparing measured movement, acceleration, and/or moment data to the data providing indicia of hand-washing activity.

When the system includes a gyroscope, the method further includes measuring movement and moment of the wearable device; determining when hand-washing activity has begun; determining when hand-washing activity has ceased; calculating a duration of hand-washing activity; and comparing the duration of hand-washing activity to a pre-determined minimum hand-washing requirement, to determine whether or not said hand-washing activity complies with the minimum hand-washing requirements.

In still another feature, the method permits identifying a wearer of the wearable device; and attributing any hand-washing activity of the wearer to a database unique to the that wearer.

Software instructions further implement algorithms to determine hand hygiene technique compliance using data from an accelerometer and/or gyroscope to determine both three-axis hand motions and duration of hand hygiene event based off the WHO's hand hygiene event specifications. As data are collected from various HCWs and workstations, automated reports may be generated including specific both global and custom-definable groups, as well as actionable data interpretation.

Other features of the present embodiments will be apparent from the accompanying drawings and from the disclosure of the various embodiments.

DETAILED DESCRIPTION OF THE INVENTION

Figure 1A:
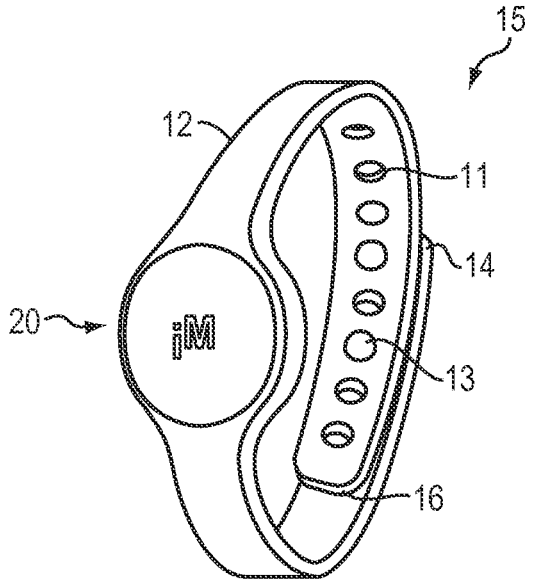
FIG. 1A illustrates a diagrammatic of an isometric view of a wearable wristband device according to one or more embodiments of the invention.
Figure 1B:
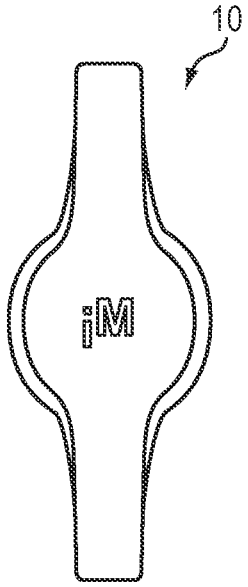
FIG. 1B illustrates a diagrammatic of a front elevation view of the wearable wristband device shown in FIG. 1A according to one or more embodiments of the invention.
Figure 1C:
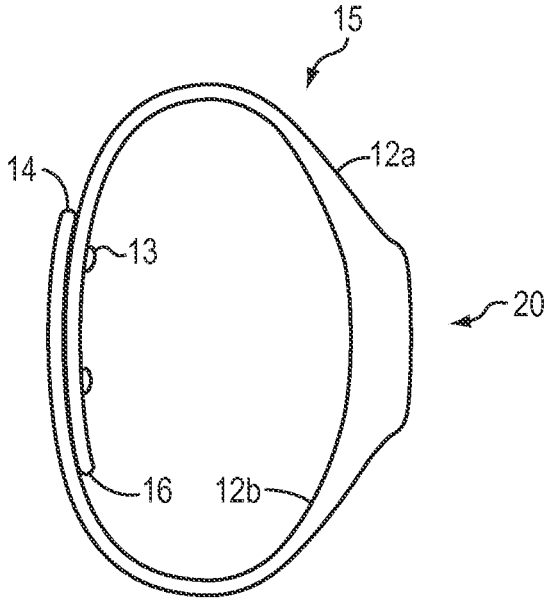
FIG. 1C illustrates a diagrammatic of a side elevation view of the wearable wristband device shown in FIG. 1A according to one or more embodiments of the invention.
Figure 2:
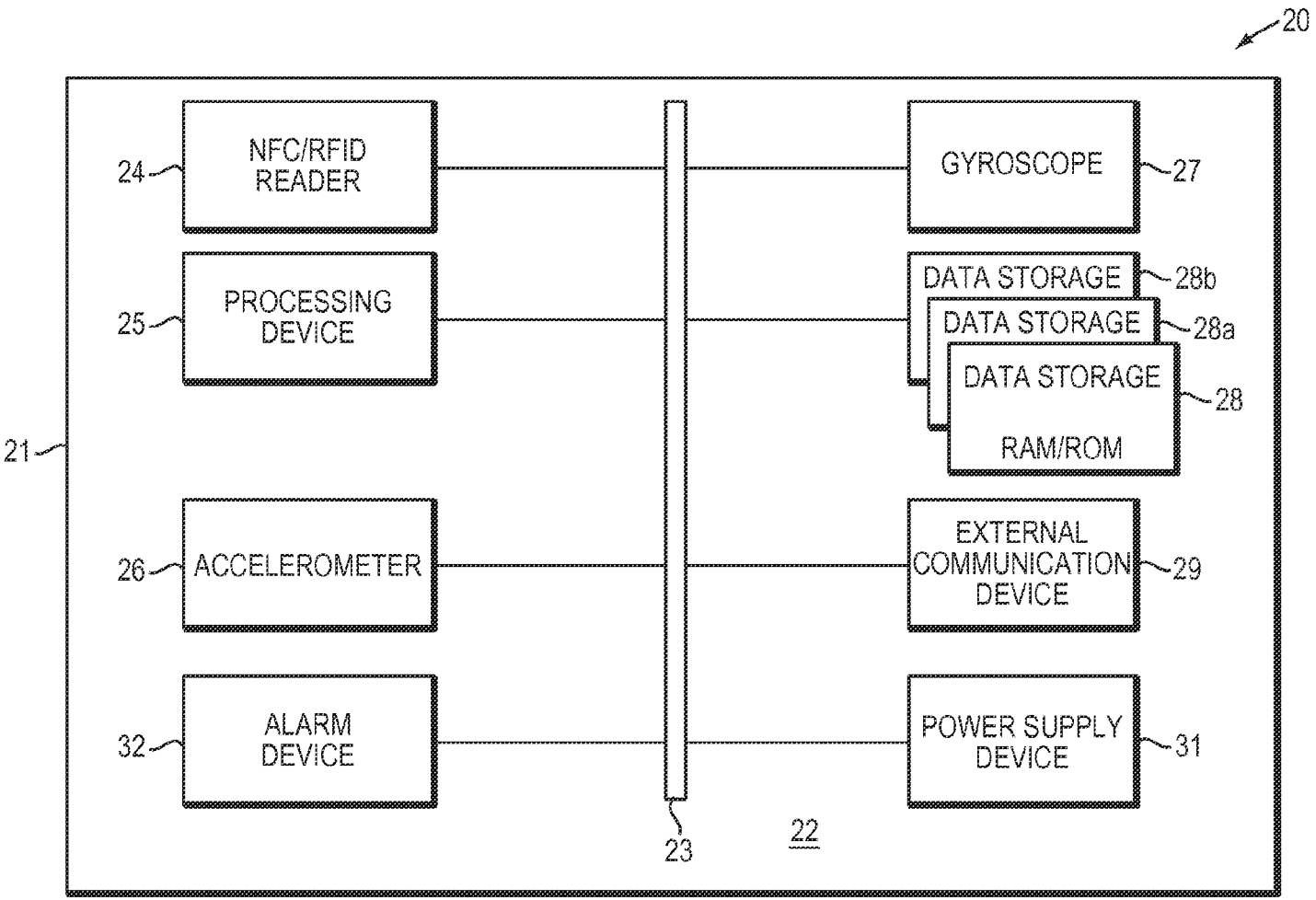
FIG. 2 shows a block diagram of an illustrative embodiment of a central housing portion of a wearable device for monitoring, collecting, storing, and transmitting data related to hand-washing tasks of the wearer according to one or more embodiments of the invention.

An illustrative embodiment of a wristband device in accordance with one or more embodiments of the present invention is shown in FIGS. 1A-1C and a block diagram of an illustrative central housing portion of the wristband device is shown in FIG. 2. The wristband device 10 includes a central housing portion 20 or "body", a cover portion 12, and an attaching portion 15.

The wristband device 10 is designed, sized, and built to minimize interference with the daily tasks of HCWs. For example, the wristband device 10 can be designed to weigh between one (1) and four (4) ounces, with a particular embodiment weighing approximately two (2) ounces. The length of the wristband device 10 may vary, and in some cases can include detachable or removable parts, e.g., the attaching portion 15, that provides a means of securely but releasably attaching the wristband device 10 to the wearer's wrist or forearm proximate the wearer's hand. In one particular embodiment the attaching portion 15 is approximately nine (9) inches in length. The width of the wristband device 10 can also vary between, for example, 0.5 inches and one (1) inch, with a particular embodiment being 0.8 inches wide. The body 20 of the wristband device 10, in which the majority of the components are housed, can also vary in size, with a specific embodiment having a circumference of approximately 1.5 inches, and being approximately 0.5 inches thick.

The cover portion 12 encases or substantially encases the central housing portion 20 and is integrated into or with the attaching portion 15 to allow the wearer to attach the wristband device 10 to his/her wrist or forearm. The cover 12 can be of multi-piece construction using a variety of materials, e.g., metal, plastic, leather, and the like. The cover portion 12 includes a top portion 12*a* and a bottom portion 12*b*, which are structured and arranged to provide a plenum into which the central housing portion 20 can be installed and secured. In manufacture, once the central housing portion 20 is installed in the plenum, the top portion 12*a* and the bottom portion 12*b* can be attached one to the other, to encase or substantially encase the central housing portion 20. Optionally, the top portion 12*a* and/or bottom portion 12*b* can include one or more openings (not shown) that, for example would permit one to observe a light-emitting device and/or to hear more clearly an audible device.

The attaching portion 15 can be an extension of the cover portion 12, providing a means for securely but releasably attaching a first end 14 of the attaching portion 15 to a second end 16 of the attaching portion 15. Although FIGS. 1A and 1C show the attaching means including a plurality of openings 11 and a plurality of posts 13, this is done for illustrative purposes only. Other attaching means can include, without limitation, a pile and hook system, a tongue and buckle system and/or a gap large enough to enable a wearer to slip his/her wrist into and out of the wristband device 10 (such as a bracelet) can be included between the ends 14 and 16 of a rigid attaching portion 15.

Referring to FIG. 2, an illustrative embodiment of the central housing portion 20 will be described. The central housing portion 20 includes a housing 21 that is structured and arranged to house and protect the other components contained therein. To that end, the housing 21 can be of cylindrical or polygonal construction having a top housing portion that is adapted to mate to a bottom housing portion, to provide when mated a shock-proof, watertight, and/or airtight seal.

A printed circuit board (PCB) 22 or the like is disposed in and fixedly attached to the base of the housing 21. The PCB 22 can be custom-designed to include physical memory storage, the other working components of the wristband device 10, and a communications bus 23. The major working components—all of which are in electrical and data communication with the bus 23 can include, without limitation: an NFC/RFID device 24, a processing device 25, an accelerometer 26, a gyroscope 27, data storing devices 28, and an external communication device 29. Auxiliary components to the watchband device 10 can include, without limitation: a power supply device 31 and an alert device 32.

The NFC/RFID device or reader 24 integrated onto the PCB 22 is structured and arranged to communicate with RFID tags that have been integrated into or have been placed in desired locations (described in greater detail below) about the medical facility. In a manner that is well-known to the art, each RFID tag is encoded with a serial number that correlates in a database to the device to which the RFID tag is affixed or otherwise related. In an intended use for the wristband device 10, passive, off-the-shelf RFID encoded tags are affixed, for example, to wash stations, hand-washing agent dispensers, medical or surgical supplies or devices, patients' beds, means of access and egress to treatment areas, and other elements within the medical facility, to provide a discrete, identifiable, low frequency RFID signal that includes the encoded serial number. Hence, in operation, when one or more NFC/RFID devices 24 is within the operational radius of an RFID tag affixed to a wash station, hand-washing agent dispenser, medical or surgical supplies or devices, bed, means of access and egress or to other elements within the medical facility, the NFC/RFID reader 24 integrated into the wristband device 10 interacts with the RFID tags, e.g., to acquire the encoded serial number of the RFID tag. Although the invention is described using radio frequency signals such as UHF signals, 802.x wireless, ZigBee, or others, those of ordinary skill in the art can appreciate that the wireless signal may also be or include an infrared signal, an ultrasonic signal, a visible spectrum radiation signal, and the like.

The processing device 25, e.g., a microprocessor, provides processing capabilities and is capable of executing applications, algorithms, driver programs, and the like that can be stored in the data storing devices 28. Data storing devices 28 can include volatile storage, e.g., random access memory (RAM) and/or non-volatile storage, for example, a read-only memory (ROM). In one or more of the embodiments of the present invention, the processing device 25 is adapted to execute at least one application, algorithm, driver program, and the like, and is further capable of receiving, storing, and performing mathematical operations on acceleration and moment data resulting from movement of the wristband device 10, and of attributing the acceleration and moment data resulting from movement of the wristband device 10 to a discrete RFID tag. Furthermore, the processing device 25 is capable of providing and transmitting the multi-dimensional acceleration ($A_x$, $A_y$, $A_z$) and the multi-dimensional moment ($M_x$, $M_y$, $M_z$) data, in their original form and/or as the data have been manipulated by mathematical operations, to the external communication device 29 for transmission. In one or more embodiments of the processing device 25, the device is capable of executing Bluetooth or other wireless functions.

The accelerometer 26 is structured and arranged to measure the multi-dimensional (x, y, z) acceleration ($A_x$, $A_y$, $A_z$) of movement of the wristband device 10 and, further, to transmit multi-dimensional acceleration ($A_x$, $A_y$, $A_z$) data to the processing device 25, e.g., wirelessly, via the bus 23, and the like. Similarly, the gyroscope 27 is an off-the-shelf circuit device that is structured and arranged to measure multi-dimensional moment ($M_x$, $M_y$, $M_z$) due to the movement of the wristband device 10 and, further, to transmit multi-dimensional moment ($M_x$, $M_y$, $M_z$) data to the processing device 25, e.g., wirelessly, via the bus 23, and the like.

The communication device 29 is, in certain embodiments, an antenna board that is structured and arranged to provide external wireless communication to a remote processing device or receiving device, which will be discussed in greater detail below. For uploading to a cloud-based server, the communication device 29 can be adapted to communicate wirelessly via a multitude of media, including but not limited to, for example, WiFi, Bluetooth, and so forth.

The power supply device 31 is structured and arranged to provide the necessary power to the other components of the wristband device 10 for a period of time consistent with a shift or work day of a typical HCW. The power supply device 31 can include a replaceable or rechargeable battery. In one or more embodiments of the present invention, the power supply device 31 includes a wireless-charging component to allow for quick charging without the need for a cord.

The alert device 32 is structured and arranged to provide visual, audible, and/or haptic feedback to the wearing HCW. When the wearing HCW fails to perform a hand-washing act or fails to perform a hand-washing act for a pre-determined length of time, the alert device 32 is adapted to perform one or more of: turning on a light-emitting device to provide a visual alert; activating an audible alarm, e.g., a chirp, to provide an audible alert; and/or starting a vibrating motor to provide haptic feedback. For the purpose of illustration and not limitation, a haptic alert device 32 will be described hereinbelow.

Figure 3:
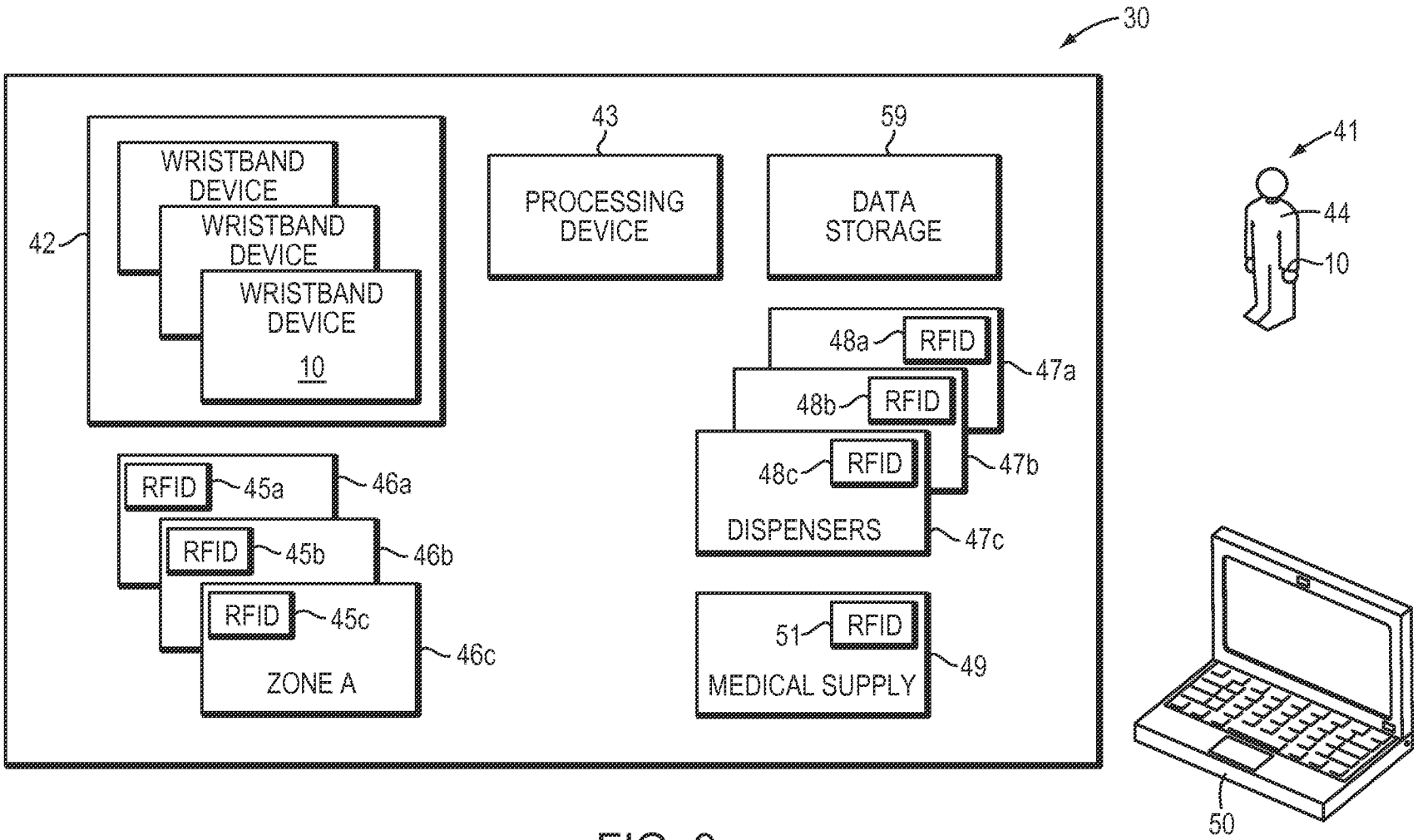
FIG. 3 shows a block diagram of an illustrative embodiment of a system for monitoring hand hygiene activity and for determining whether such activity complies with certain guidelines according to one or more embodiments of the invention.
Figure 4A:
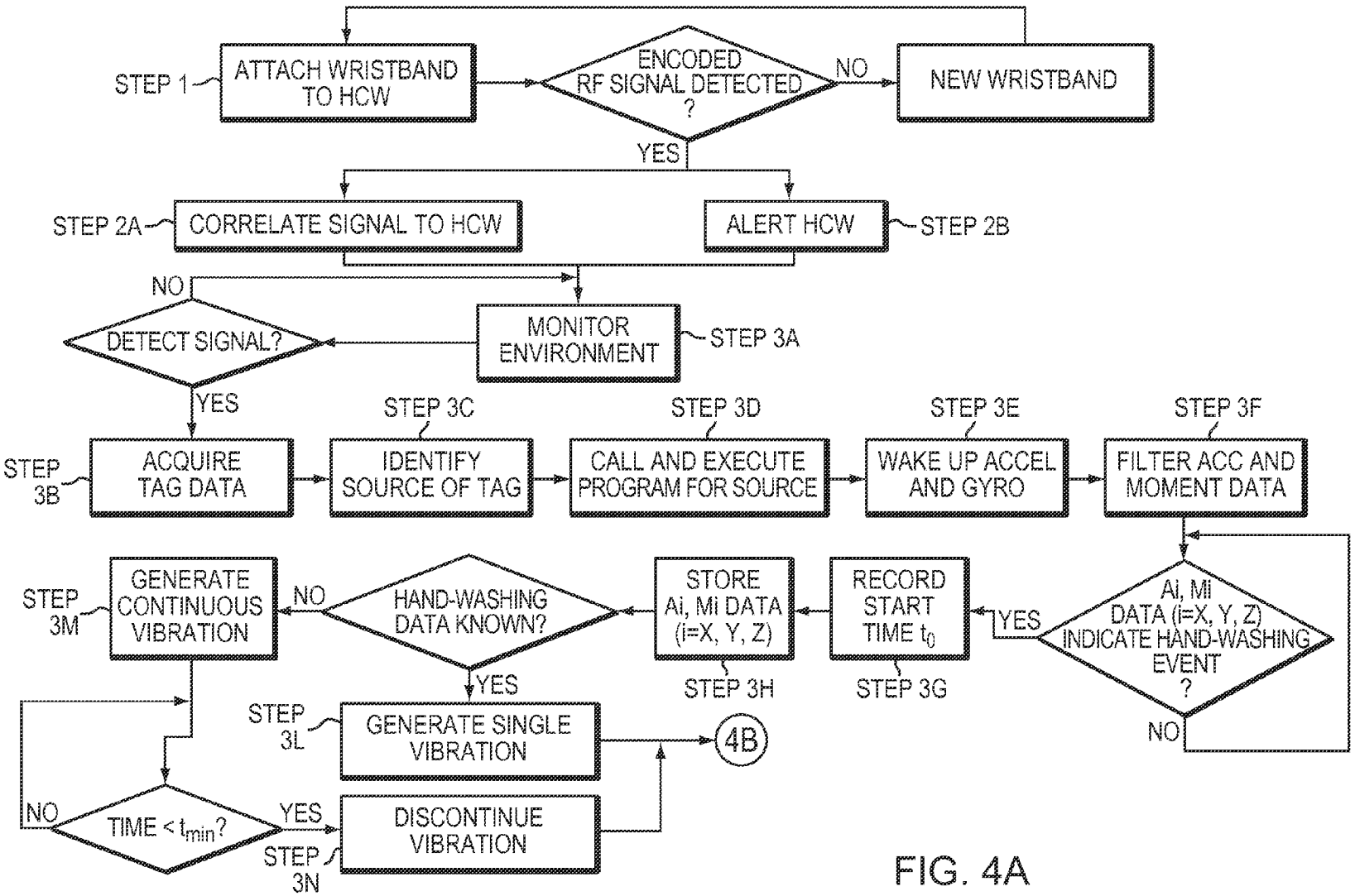
FIGS. 4A, 4B, and 4C show a flow diagram of an illustrative embodiment of a method of monitoring hand hygiene activity and of determining whether such activity complies with certain guidelines according to one or more embodiments of the invention.
Figure 4B:
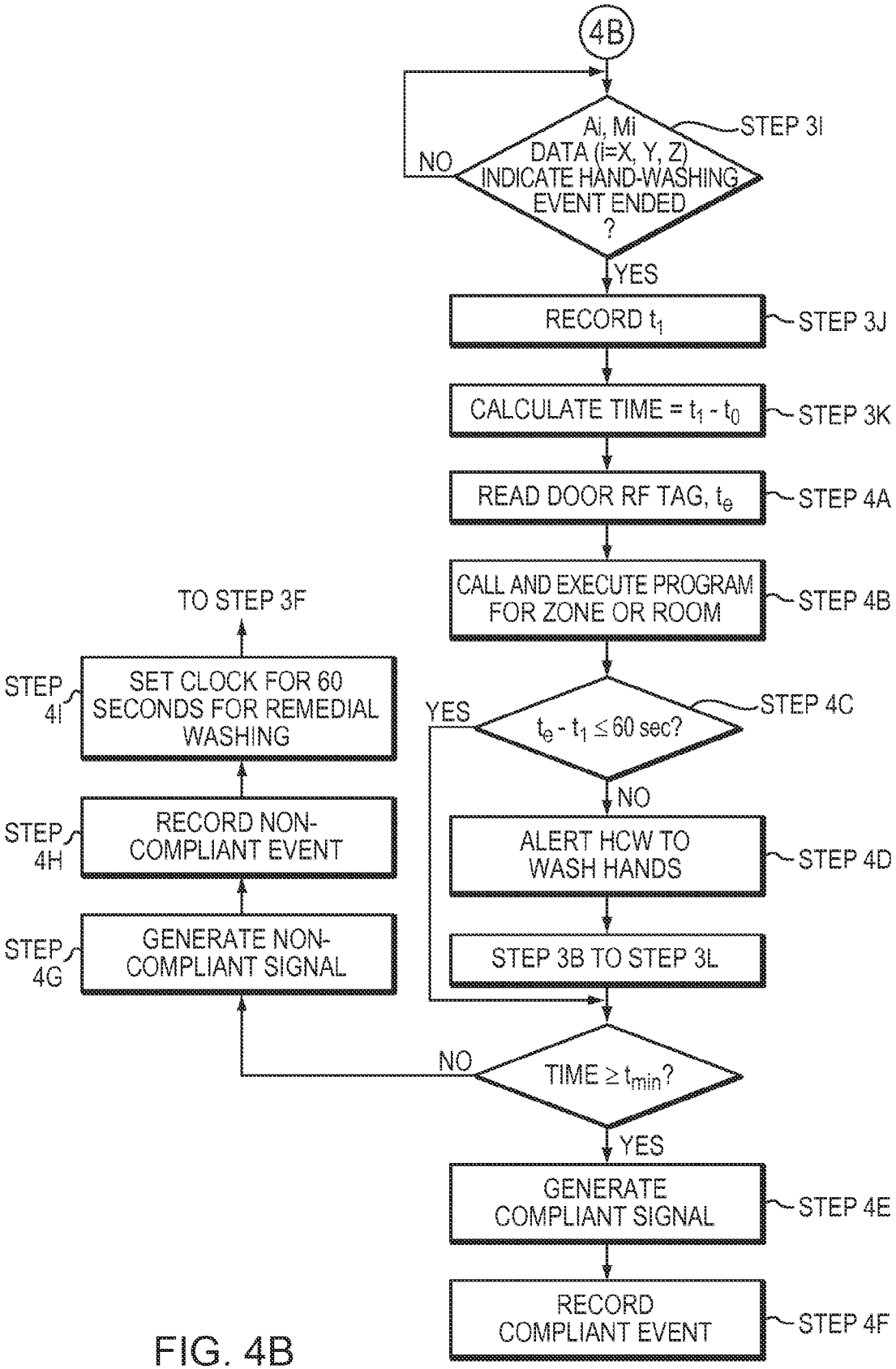
Figure 4C:
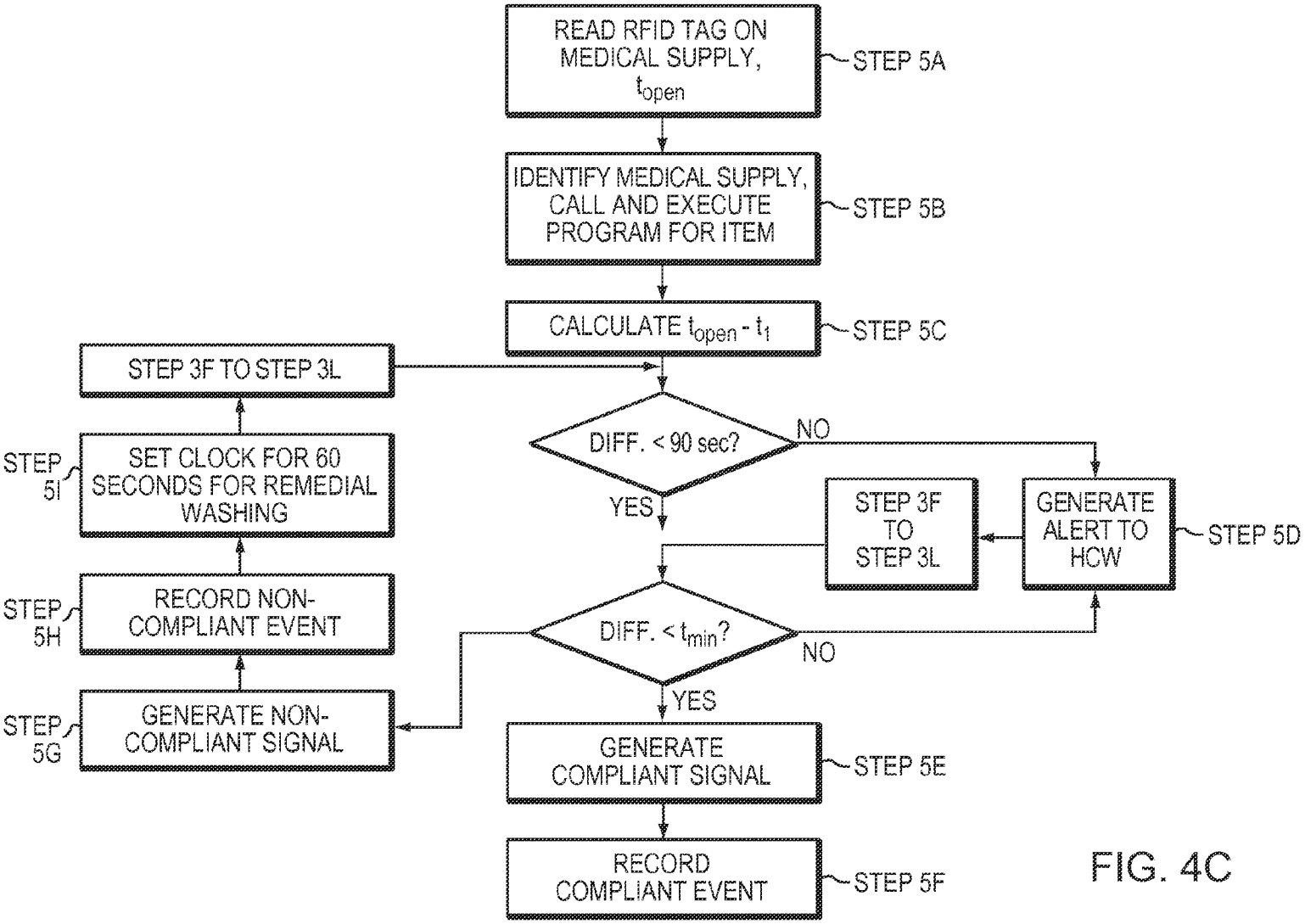

Having described a wristband device 10, a system for and a method of monitoring hand hygiene activity and determining whether such activity complies with certain pre-established guidelines, e.g., WHO guidelines, will now be described. FIG. 3 shows a block diagram of an illustrative embodiment of a system 30 for monitoring hand hygiene activity and for determining whether such activity conforms to compliance guidelines. FIGS. 4A-4C show a flow diagram of an illustrative embodiment of a method of monitoring and enforcing hand hygiene activity and of determining whether such activity conforms to compliance guidelines. For ease of understanding, embodiments of the system and the method will be described using examples of an intended use in the healthcare industry. Although the example focuses on the healthcare industry, the invention is not to be construed narrowly to apply only to that field. Indeed, those of ordinary skill in the art can readily apply the teachings herein to a myriad of other environments such as the food service industry, child care facilities, educational facilities, and the like.

Referring to FIG. 3 and FIGS. 4A to 4C, in practice, each HCW 41 begins his shift by removing a fully-charged or a substantially fully-charged wristband device 10 from a charger housing device 42 and attaching the wristband device 10 to his wrist or forearm (left or right), proximate the HCW's hand (STEP 1). In some embodiments, the charger housing device 42 retains multiple, e.g., 12, wristband devices 10 as a charging "hub", which can typically be located near a processing device 43 located at or near a nursing station. The HCW 41 would then move his/her wristband device 10 proximate the HCW's hospital name badge to which a passive RFID tag 44 is affixed and being encoded with a serial number that is transmitted to and received by the NFC/RFID reader 24. The processing device 25 is adapted to use the received RF signal to correlate the selected wristband 10 to the discrete HCW 41 (STEP 2A). More specifically, the processing device 25 is adapted to correlate all subsequent monitored activity associated with the selected wristband device 10 to discrete personal data about the HCW 41 (STEP 2A). These data may be stored in local and/or remote databases 59 accessible by the processing device 43. Representative personal data about the HCW 41 that can be stored in the database 59 include, without limitation, the HCW's name, the HCW's profession or role in the organization (e.g., nurse, physician, custodial personnel, candy-striper, and so forth), the unit, ward or department in which the HCW 41 works, the applicable hospital, and so forth. Once the NFC/RFID reader 24 in the wristband device 10 has received the encoded serial number from the HCW's name badge and transmitted the same to the processing device 25, the processing device 25 generates a signal to the alert device 32 (STEP 2B) to provide visual, audible, and/or haptic feedback, i.e., green light on, chirp once, or vibrate once, to confirm attribution of the wristband device 10 to the discrete HCW 41 (STEP 2A). This process alleviates the need to have a one-to-one association of wristband devices 10 to HCWs 41, allowing for the reuse of wristband devices 10 across the user population. In an alternate embodiment, each HCW 41 can be provided his/her own wristband device 10, which would eliminate the attribution and alert steps (STEPS 2A and 2B). Once the wristband device 10 has been attributed to its wearer, it actively seeks RF signals from any one of three RFID tag types: RFID tags 48*a-c* affixed to a wash station, hand-washing agent dispenser

47*a-c*, and the like; RFID tags 45*a-c* affixed to a means of access or egress, passageway or room; and RFID tags 51 affixed to a medical or surgical device, supply item or another element within the medical facility, each of which will be discussed in order hereinbelow.

As previously described, the NFC/RFID reader 24 in the wristband device 10 actively monitors (STEP 3A) its environment for signals from RFID tags 48. Once an NFC/RFID device 24 is within the operational radius of an RFID tag 48*a-c* affixed to a wash station, hand-washing agent dispenser 47*a-c*, and the like, the NFC/RFID reader 24 interacts with the RFID tag 48 to acquire the encoded serial number of the RFID tag 48 (STEP 3B). RFID tag data are then transmitted to the processing device 25, which, upon receipt, identifies the source (in this case a hand-washing agent dispenser 47) (STEP 3C); calls and executes an application, algorithm, driver program, and the like appropriate for the source (STEP 3D); wakes up the dormant accelerometer 26 and/or gyroscope 27 (STEP 3E); receives and filters three-dimensional acceleration ($A_x$, $A_y$, $A_z$) and/or three-dimensional moment ($M_x$, $M_y$, $M_z$) data transmitted, respectively, by the accelerometer 26 and the gyroscope 27 (STEP 3F). Filtering includes comparing the acceleration ($A_x$, $A_y$, $A_z$) and/or moment ($M_x$, $M_y$, $M_z$) data to a corresponding database 28*b*, e.g. look-up tables and the like, that contains representative hand-washing acceleration ($A_x$, $A_y$, $A_z$) and moment ($M_x$, $M_y$, $M_z$) data (STEP 3F), to ascertain whether and when the HCW 41 is performing hand-washing activity. As provided in the Background of the Invention section, supra., WHO guidelines provide minimum hand-washing requirements for five levels of anticipated or on-going patient contact. Accordingly, the minimum hand-washing requirements for each of the five categories of the WHO guideline—which may change from time to time—can be stored in another database 28*a*.

Once the compared data indicate to the processing device 25 that hand-washing activity has been initiated, the processing device 25 records the time of initiation ($t_o$) (STEP 3G) and begins to store acceleration ($A_x$, $A_y$, $A_z$) and/or moment ($M_x$, $M_y$, $M_z$) data (STEP 3H), attributing the received accelerometer and/or gyroscope data to the HCW 41 and the acquired RFID tag data 48. The processing device 25 will continue to filter and compare transmitted acceleration ($A_x$, $A_y$, $A_z$) and moment ($M_x$, $M_y$, $M_z$) data to the database 28*b* containing representative hand-washing acceleration ($A_x$, $A_y$, $A_z$) and moment ($M_x$, $M_y$, $M_z$) data until the compared data provide indicia that the hand-washing activity has been terminated (STEP 3I). Once the compared data indicate to the processing device 25 that hand-washing activity has ended, the processing device 25 records the end time ($t_1$) (STEP 3J) and calculates the elapsed time of the hand-washing activity (time= $t_1-t_0$) (STEP 3K).

Advantageously, once the compared data indicate to the processing device 25 that hand-washing activity has been initiated (STEP 3F), the processing device 25 can also activate the alert device 32, e.g., cause it to vibrate (STEP 3L), to inform the HCW 41 that his hand-washing activity is being timed and recorded. In one embodiment of the invention, as a default or when a minimum hand-washing time ($t_{min}$) is unknown, the alert device 32 will vibrate just once (STEP 3L). In another embodiment, when the minimum hand-washing time ($t_{min}$) is known, the alert device 32 will continue to be activated, e.g., vibrate continuously (STEP 3M), until a corresponding minimum hand-washing time ($t_{min}$) is reached. The minimum hand-washing times would be or have been established by published hand hygiene guidelines, e.g., WHO guidelines. Hence, in the alternative embodiment, if a HCW 41 terminates hand-washing activity prior to the pre-determined minimum hand-washing time ($t_{min}$), i.e., time<$t_{min}$, the alert device 32 will continue to operate, i.e., vibrate, alerting the HCW 41 that he/she has not complied with the minimum hand-washing activity according to the hand hygiene guidelines. Otherwise, once the time of hand-washing activity equals or exceeds the pre-determined minimum hand-washing time ($t_{min}$), i.e., time≥$t_{min}$, the processing device 25 will automatically de-activate the alert device 32 (STEP 3N).

The above description (STEP 3A to STEP 3N) may take place before a HCW 41 enters a zone or room 46 or after he enters a zone or room 46. So, for example, as a HCW 41 approaches a patient room 46 and before entry he uses the sanitizer dispenser 47 located outside the room 46. The RF signal from the passive encoded tag 48 affixed to the dispenser 47 informs the wristband device 10 that it is a sanitizer dispenser 47 in use and its physical location 46, e.g., outside Room 404 at ABC Hospital. The wristband device 10 vibrates once as the HCW's hands are placed under the dispenser 47 based on the proximity of the NFC/RFID reader 24 to the tag 48 affixed to the dispenser 47, to alert the HCW 41, inter alia, that the event is being recorded. This allows for 100% accuracy of hand hygiene recording. If, however, there is no vibration, no acceleration or moment data are recorded.

As the HCW 41 initiates hand-washing activity by manually rubbing the hand-washing agent, e.g. an alcohol based hand rub (ABHR), solution, soap and water, and the like, on his hands, the processing device 25 wakes up the accelerometer 26 and gyroscope 27 based on data signals from the tags 48 associated with the sanitizer or soap dispenser 47. The processing device 25 executes the hand-washing activity (STEP 3A to STEP 3N), receiving signal data from the accelerometer 26 and/or gyroscope 27, which are used to determine hand-washing activity time and thoroughness and compliance/non-compliance with appropriate WHO guidelines.

Within the hospital en gross and the HCW's particular place of engagement, e.g., his unit, ward, and the like, a multiplicity of RFID tags are distributed and affixed. For example, Bluetooth-enabled, directionally controlled tags 45*a-c* can be placed on means of access and egress, i.e., doorways, within particular rooms or zones 46*a-c* themselves, along passageways, and so forth in a manner such that as the HCW 41 and, more specifically, his wristband device 10 nears or passes through a doorway or along a passageway, the NFC/RFID reader 24 captures data of the entry event and transmits these data to the processing device 25 for use and storage (STEP 4A). "Entry event" data can include, without limitation, the time of entry ($t_e$) and the classification of the zone or room 46 entered. Zone classification is used to call and execute an application, algorithm, driver program, and the like that is stored in an appropriate database 28 and, moreover, that provides the appropriate minimum hand-washing requirements ($t_{min}$) and degree of hand motion from the database 28*b* (STEP 4B).

According to the present invention, once a HCW 41 has passed through a means of access and egress and transitioned from one zone or room 46 to another zone or room 46, the length of time since the HCW's last hand-washing activity, which can be calculated using the following formula:

$$t_e-t_1,$$

is compared to a pre-established guideline (STEP 4C). Thus, if an HCW 41 did not wash his hands at all or had washed his hands but not within a pre-determined length of time, e.g., 60 seconds, before entering a zone or room 46, the alarm device 32 will alert the HCW 41 (STEP 4D), e.g., using a continuous pulsing vibration, of the need to perform compliant hand-washing activity. The system 20 would then take the HCW 41 through STEP 3F to STEP 3L described in detail above. After STEP 3K, if the HCW's hand-washing activity time equals or exceeds the pre-determined minimum hand-washing time ($t_{min}$), i.e., time≥$t_{min}$, then a compliant message is sent to the HCW 41 (STEP 4E) and a record of the compliant event is date/time stamped (STEP 4F) and stored in an appropriate database 28 for future uploading and reporting.

If, however, the length of HCW's hand-washing activity time is less than the pre-determined minimum hand-washing time ($t_{min}$), i.e., time<$t_{min}$, then a non-compliant signal is generated, e.g., three short vibrations, (STEP 4G) and a record of a noncompliant event is date/time stamped (STEP 4H) and stored in an appropriate database 28 for future uploading and reporting. In the event of a noncompliant message, the HCW 41 would be given a threshold time (STEP 4I), e.g., 60 seconds, to re-commence and complete a compliant hand-washing activity (STEP 3F to STEP 3L), to override the noncompliant event result and to receive a single vibration indicating full compliance (STEP 4E). For example, if the original hand-washing activity was correct in hand motion as evidenced by data from the accelerometer 26 and/or gyroscope 27 but only lasted for 10 of the 15 seconds needed for compliance, renewed hand-washing activity initiated within the pre-defined threshold time, e.g., within 60 seconds, would generate a single vibration (STEP 4E) after five additional seconds of compliant hand-washing activity.

During his/her stay in a zone or room 46, the HCW 41 may also perform certain tasks in the presence of a patient, e.g., inserting a central blood line, that may require further sanitization action as defined by the WHO or other guidelines. Advantageously, the system 20 can also identify these tasks and call and execute an application, algorithm, driver program, and the like that is stored in an appropriate database 28 that provides the appropriate minimum hand-washing requirements ($t_{min}$) and degree of hand motion from the database 28*b*, using tag recognition associated with a particular medical device, medical supply, and the like 49. For example, using the central blood line example, the HCW 41 opens IV packaging 49 used for a central blood line insertion to which a passive RF tag 51 is affixed. The processing device 25 identifies the corresponding IV packaging 49 from the RF tag signal it receives and records the time of opening 11 (STEP 5A). If the IV packaging 49 is one for which one of the five categories of the WHO guidelines is associated, the processing device 25 calls and executes an application, algorithm, driver program, and the like that is stored in an appropriate database 28 and that provides the appropriate minimum hand-washing requirements ($t_{min}$) and degree of hand motion from the database 28*b* (STEP 5B). The processing device would then essentially follow the same procedure described hereinabove. For example, the length of time since the HCW's last hand-washing activity can be calculated using the following formula:

$$t_{open}-t_1,$$

and compared to a pre-established guideline (STEP 5C). Thus, if an HCW 41 did not wash his/her hands at all or had washed his/her hands but not within a pre-determined length of time, e.g., within 90 seconds, of opening the medical supply 49 or if the length of the HCW's hand-washing activity falls short of the new requirements for the central blood line insertion, the alarm device 32 will alert the HCW 41 (STEP 5D), e.g., a continuous pulsing vibration, of the need to perform compliant hand-washing activity. The system 20 would then take the HCW 41 through STEP 3B to STEP 3L described in detail above. After STEP 3K, if the HCW's hand-washing activity time equals or exceeds the pre-determined minimum hand-washing time ($t_{min}$), i.e., time≥$t_{min}$, then a compliant message is generated (STEP 5E) and a record of the compliant event is date/time stamped (STEP 5F) and stored in an appropriate database 28 for future uploading and reporting.

If, however, the HCW's hand-washing activity time is less than the pre-determined minimum hand-washing time ($t_{min}$), i.e., time<$t_{min}$, then a noncompliant message, e.g., three vibrations, is generated (STEP 5G) and a record of the noncompliant event is date/time stamped (STEP 5H) and stored in an appropriate database 28 for future uploading and reporting. The HCW 41 would then be given a threshold time (STEP 5I), e.g., 60 seconds, to re-commence and complete a compliant hand-washing activity (STEP 3F to STEP 3L), to override the noncompliant event result and to receive a single vibration indicating full compliance (STEP 5E).

The HCW 41 wears and uses the wristband device 41 throughout his shift. At the end of the shift, the wristband device 10 is returned to and plugged into the charger housing device 42 for charging, data uploading, and application updates. More specifically, during the HCW's shift, the processing device 25 records, stores, and reports the data locally on the wristband device 10. However, once it is re-docked in the hub 42, the processing device 25 and the external communication device 29 upload all stored data, including records of compliant and noncompliant events, to a cloud-based storage and application service 50, while any firmware or application updates are applied to the applications, algorithms, driver programs, and the like disposed in any of the data storing devices 28. The cloud-based storage and application service 50 compiles the data looking for trends, missed opportunities, and compliance issues. The cloud-based storage and application service 50 also uses data from a plurality of HCWs 41 to calculate a specific hand hygiene compliance percentage using the formula:

$$\frac{\text{total occurrences of hand hygiene events}}{\text{total opportunities for hand hygiene events}} \times 100\%$$

for the individual HCW 41, for his/her department, and for the medical facility.

The charger housing device 42 communicates with the processing device 43, which is structured and arranged to store and to execute applications, algorithms, driver programs, and the like that control wristband device 10 charging, initiate remote diagnostics, upload collected data to a remote, cloud-based server upon re-docking, and, as necessary, download remote software and firmware updates. The processing device 43 is also capable of using the data to prepare reports of compliance and noncompliance.

Although the invention has been described for use in connection with a healthcare application, this is not to say that it cannot be applied to other fields. For example, in the food service industry, a food service worker (FSW) wearing a wristband device enters a bathroom which has a door RF. The wristband device vibrates once to alert the FSW that the action of using the restroom is being recorded. If the FSW does not interact with a soap dispenser RF tag and/or perform a compliant hand hygiene event as determined by the accelerometer and/or gyroscope, noncompliance is recorded and reported. If the FSW places their hand under the soap dispenser that is tagged with a passive RFID tag that is location encoded, e.g., Wendy's #342 men's room) the accelerometer and/or gyroscope wake up and execute the same hand hygiene technique analysis described above for HCW's. The information is recorded and reported using a similar hub and client-based application having ISP/network access to send the data to the cloud-based server.

In a general consumer application, the band may also be used to encourage and engage users to follow good hygiene habits. For example, a passive RFID tag can be disposed inside of a bar of soap. When a child wearing a wristband device washes his/her hands, the wristband device detects the RF tag signal which can be encoded with data about the type of soap, brand of soap, geographic location sold, and so forth. The band performs the same hand washing technique analysis using the comparison algorithms and alerts visually, audible and/or haptically the compliance or noncompliance of the specific event. These data can be pushed to a web-based platform or mobile device via USB or Bluetooth to allow the gamification of the data in an effort to increase hand hygiene compliance for children.

The invention claimed is:

1. A lightweight, wearable device comprising:

a radio frequency identification tag reader;

an external communication device that is structured and arranged to communicate with a remote server;

an alarm device that is adapted to generate at least one of a visual, an audible, and a haptic signal;

at least one data storing device for storing data and at least one of an application, an algorithm, and a driver program having multi-dimensional movement and acceleration data representative of hand-washing activity;

an accelerometer that is structured and arranged to measure multi-dimensional movement and acceleration of the device;

a processing device that is in communication with the radio frequency identification tag reader, the external communication device, the alarm device, the at least one data storing device, and the accelerometer, the processing device being adapted to call and execute an appropriate at least one application, algorithm, and driver program that uses measured multi-dimensional movement and acceleration data to evaluate hand-washing activity; and a central housing portion into which components of the device are structured and arranged, the central housing portion being at least one of shockproof, watertight, and airtight, the device useable in a method of monitoring an instance and a duration of hand-washing activity, the method comprising:

monitoring an environment for identification tag signals;

identifying a source of a monitored tag signal, the source taken from any of a plurality of dispensers, a plurality of directionally-controlled tags, and a plurality of unique passive radio frequency tags;

calling from a database and executing at least one of an application, an algorithm, and a driver program corresponding to the identified signal source;

measuring movement and acceleration of the wearable device;

determining when hand-washing activity has begun by comparing measured movement and acceleration data to data providing indicia of hand-washing activity stored in a corresponding database;

determining when hand-washing activity has ceased by comparing measured movement and acceleration data to the data providing indicia of hand-washing activity;

calculating a duration of hand-washing activity;

comparing the duration of hand-washing activity to a predetermined minimum handwashing requirement, to determine whether or not said hand-washing activity complies with the minimum hand-washing requirements;

calculating a duration of time between a most recent hand-washing activity and at least one of an entry time into a zone or room and an opening time of a medical supply or medical device;

determining whether or not the duration of time is less than or equal to a pre-established threshold time; and alerting a wearer of the wearable device to perform remedial hand-washing activity if said duration of time is less than the pre-established threshold time.

2. The device as recited in claim 1 further comprising a gyroscope that is structured and arranged to measure multi-dimensional movement and moment of the device, and wherein the processing device is adapted to call and execute an appropriate at least one application, algorithm, and driver program that uses measured multi-dimensional movement and moment data to evaluate hand-washing activity.

3. The device as recited in claim 1, wherein the wearable device has at least one of the following properties:

weighs between one (1) and four (4) ounces;

has a thickness of approximately 0.5 inches; and has a width between 0.5 inches and one (1) inch.

4. The device as recited in claim 3, wherein the wearable device has at least one of the following properties:

weighs approximately two (2) ounces; and has a width of approximately 0.8 inches.

5. The device as recited in claim 1, wherein the wearable device is selected from a group consisting of:

a wristband device;

a ring; and an armband device.

6. The device as recited in claim 1 further comprising:

a cover portion that is structured and arranged to encase or substantially encase the central housing portion; and an attaching portion that is fixedly attached to or integrated into the cover portion for releasably securing the device at or near a wearer's wrist.

7. The device as recited in claim 1 further comprising a power supply device having a wireless charging component.

8. The method as recited in claim 1, wherein the minimum hand-washing requirements are provided in guidelines that are stored in an appropriate database.

9. The method as recited in claim 8, wherein the guidelines are World Health Organization guidelines for hand hygiene.

10. The method as recited in claim 1 further comprising generating a continuous alarm signal until said remedial hand-washing activity complies with the minimum hand-washing requirements.

11. The method as recited in claim 1 further comprising:

generating a signal of noncompliance if said duration is less than the pre-established threshold time; and recording in the data storing device of the wearable device a date and time of the noncompliance signal.

12. The method as recited in claim 11, further comprising:

determining when a remedial hand-washing activity has begun by comparing measured movement and acceleration data to data providing indicia of hand-washing activity stored in a corresponding database;

determining when the remedial hand-washing activity has ceased by comparing measured movement and acceleration data to the data providing indicia of hand-washing activity;

calculating a duration of remedial hand-washing activity; and comparing the duration of re-medial hand-washing activity to the pre-determined minimum hand-washing requirements, to determine whether or not said remedial hand-washing activity complies with the minimum hand-washing requirements.

13. The method as recited in claim 12 further comprising generating a continuous alarm signal until said remedial hand-washing activity complies with the minimum hand-washing requirements.

14. The method as recited in claim 1, the wearable device further including a gyroscope that is structured and arranged to measure multi-dimensional movement and moment of the device, the method further comprising:

measuring movement and moment of the wearable device;

determining when hand-washing activity has begun by comparing measured movement and moment data to data providing indicia of hand-washing activity stored in a corresponding database;

determining when hand-washing activity has ceased by comparing measured movement and moment to the data providing indicia of hand-washing activity;

calculating a duration of hand-washing activity therefrom; and comparing the duration of hand-washing activity to a pre-determined minimum hand-washing requirement, to determine whether or not said hand-washing activity complies with the minimum hand-washing requirements.

15. The method as recited in claim 1 further comprising:

identifying a wearer of the wearable device; and attributing any hand-washing activity of the wearer to a database unique to the corresponding wearer.

16. The method as recited in claim 1 further comprising generating a signal to notify the wearer that movement and acceleration data are being recorded.

* * * * *